US010794347B1

(12) United States Patent
Parsons et al.

(10) Patent No.: US 10,794,347 B1
(45) Date of Patent: Oct. 6, 2020

(54) ROLLER REACTION FORCE LUBRICATION SYSTEM

(71) Applicants: Antony Owen Parsons, Worcestershire (GB); Enda M. Walsh, Castlebar (IE); Jim Askew, Gloucestershire (GB)

(72) Inventors: Antony Owen Parsons, Worcestershire (GB); Enda M. Walsh, Castlebar (IE); Jim Askew, Gloucestershire (GB)

(73) Assignee: Woodward, Inc., Fort Collins, CO (US)

( * ) Notice: Subject to any disclaimer, the term of this patent is extended or adjusted under 35 U.S.C. 154(b) by 0 days.

(21) Appl. No.: 16/537,560

(22) Filed: Aug. 10, 2019

(51) Int. Cl.
*F02M 59/10* (2006.01)
*F01L 1/14* (2006.01)

(52) U.S. Cl.
CPC ..... *F02M 59/102* (2013.01); *F01L 1/14* (2013.01)

(58) Field of Classification Search
CPC .... F01L 1/14; F01L 1/143; F01L 1/16; F02M 59/102
USPC ..... 123/90.48
See application file for complete search history.

(56) References Cited

U.S. PATENT DOCUMENTS 4,361,120 A * 11/1982 Kueny ..... F01L 1/14 123/90.5
2003/0145818 A1* 8/2003 Vene ..... F01L 1/146 123/90.48
2015/0176691 A1* 6/2015 Champalou ..... F16C 13/02 74/569
2016/0160695 A1* 6/2016 Hattiangadi ..... F01L 1/146 123/90.35
2017/0107863 A1* 4/2017 Di Nunno ..... F04B 9/042
2017/0145877 A1* 5/2017 Hauvespre ..... F01M 9/105

FOREIGN PATENT DOCUMENTS

WO WO-2018059900 A1 * 4/2018 ..... F02M 63/0001

* cited by examiner

*Primary Examiner* — Jorge L Leon, Jr.
(74) *Attorney, Agent, or Firm* — Reinhart Boerner Van Deuren P.C.

(57) ABSTRACT

Embodiments of a tappet are disclosed herein. The tappet has a front and a back, and the tappet includes a first stirrup and a second stirrup. The first stirrup has a first opening with a plurality of angular positions from 0° to 360°. The angular position of 90° and 270° correspond to the back and front of the tappet, respectively. The second stirrup has a second opening. The first and second openings are configured to carry a roller pin on which the roller is provided. The first stirrup includes a first region having a first depth below a first interior surface of the first stirrup. The first region extends from 150° to 210° around the first opening. The first region has a first end located at an angular position of between 180° and 270° and a second end located at an angular position of between 0° and 90°.

20 Claims, 5 Drawing Sheets

ROLLER REACTION FORCE LUBRICATION SYSTEM

FIELD OF THE INVENTION

This invention generally relates to a pump and more particularly to a tappet utilized in a pump.

BACKGROUND OF THE INVENTION

A common rail pump is used for pumping fluids, particularly fuel for engines. Certain embodiments of the pump includes a camshaft with roller tappets. The roller tappets are held against lobes of the camshaft to convert rotational motion of the camshaft into linear motion for lifting pumping plungers relative to a pumping barrel. Return springs are used to bias the roller tappets towards the camshaft. When the camshaft is rotated to a position where the a lobe of the camshaft has a small radius, the return spring pushes the roller tappet back to the starting position relative to the camshaft in preparation for the next rotation of the camshaft and pumping motion. The cyclical movement of the plungers in the pumping barrels pressurizes the fluid and pumps the fluid.

In some pumps, this cyclic movement of the plunger causes the roller of the roller tappet to press against and dig into one side of the tappet. Further, if the pump is run in reverse, the roller will predictably press against the other side of the tappet. The mechanism causing the roller to dig into the sides of the tappet relates to the direction of winding of the coils in the return spring, which causes rotation of the tappet during compression. This rotation causes the roller axis to deviate and the roller to dig into the side of the tappet. Roller tappets used in high-pressure common rail (HPCR) generation fuel pumps are susceptible to damage on roller hubs due to these side forces pushing them against the inside surface of the tappet. The damage can, in extreme circumstances, generate sufficient frictional heat to create microcracks which could propagate and break the roller. Conventional designs have concentrated on selecting materials that can resist the heating or that try to create a cushion of lubrication between the roller hub and the tappet surface. However, in some cases, conventional methods to deliver oil to the surface have not been successful.

As will be discussed herein, embodiments of the present disclosure address the issue of the side forces on the roller and associated microcracking and breaking through an improved design of the tappet in regions where the roller would conventionally rub and dig into the tappet. These and other advantages of the invention, as well as additional inventive features, will be apparent from the description of the invention provided herein.

BRIEF SUMMARY OF THE INVENTION

According to the present disclosure, a tappet for a roller tappet is provided with surfaces engineered to create preferential touch points between the roller and the tappet. In particular, in regions where the roller is expected to dig into the tappet, material is removed from the interior tappet surface (or the interior tappet surface is formed in a manner that creates a region with a lower depth). This region can then be used to direct lubricating oils into the roller/tappet interface. In regions where contact is not expected or not expected to create excessive wear, no material is removed, and oil can be entrained between the surfaces of the roller and tappet by drawing the oil from the regions of material removal. In this way, lubrication oil is targeted more accurately to the areas where contact is predicted and can be flushed for cooling in areas where no contact is desired. These and other aspects and advantages will be discussed in relation to the embodiments described below and shown in the drawings. These embodiments are presented by way of illustration and not by way of limitation.

An exemplary embodiment of the present disclosure relates to a tappet for carrying a roller that follows a cam surface. The tappet has a front and a back, and the tappet includes a first stirrup and a second stirrup. The first stirrup has a first stirrup opening with a plurality of angular positions from 0° to 360°. The angular position of 90° corresponds to the back of the tappet, and the angular position of 270° corresponds to the front of the tappet. The second stirrup has a second stirrup opening. The first stirrup opening and the second stirrup opening are configured to carry a roller pin on which the roller is provided. The first stirrup includes a first region having a first depth below a first interior surface of the first stirrup. The first region extends from 150° to 210° around the first stirrup opening. The first region has a first end located at an angular position of between 180° and 270° around the first stirrup opening and a second end located at an angular position of between 0° and 90° around the first stirrup opening.

In embodiments of the tappet, the first depth of the first region is from 0.010 mm to 0.100 mm below the first interior surface. In such embodiments, at least one of the first end or the second end of the first region includes a ramped surface. The ramped surface forms an angle of from 5° to 30° with a plane defined by the first interior surface.

In embodiments of the tappet, the first region is continuous between the first end and the second end. However, in other embodiments, the first region is discontinuous between the first end and the second end. In such embodiments, the first region is divided into a first section and a second section separated by an interruption. The interruption has a surface that is flush with the first interior surface. Additionally, in embodiments, the interruption is located at an angular position between 270° and 360° around the first stirrup opening. Further, the first stirrup may further include a counter region having the first depth below the first interior surface. The counter region may be located at an angular position between 90° and 180° around the first stirrup opening. Moreover, the counter region may be arranged diametrically to the interruption of the first region. In certain embodiments, the roller pin defines a roller pin axis, and the roller has a hub face with a first radius extending from the roller pin axis. Preferably, the counter region has a width defining a second radius from the roller pin axis that is less than the first radius.

In still other embodiments, the second stirrup has a second region having a second depth below a second interior surface of the second stirrup. The second region extends from 150° to 210° around the second stirrup opening. In such embodiments, the second region of the second stirrup may substantially mirror the first region of the first stirrup.

Further, in embodiments, the roller pin defines a roller pin axis, and the roller has a hub face with a first radius extending from the roller pin axis. The first region has a width defining a second radius from the roller pin axis that is greater than the first radius.

Another exemplary embodiment of the present disclosure relates to a roller tappet. The roller tappet includes a roller, a roller pin carrying the roller, and a tappet including a first stirrup having a first stirrup opening and a second stirrup having a second stirrup opening. The first stirrup opening and the second stirrup opening carry the roller pin on which the roller is provided. The first stirrup opening has a plurality of angular positions from 0° to 360° with 90° corresponding to the back of the tappet and 270° corresponding to the front of the tappet. The first stirrup includes a first region having a first depth below a first interior surface of the first stirrup. The first region extends from 150° to 210° around the first stirrup opening. Further, the first region has a first end located at an angular position of between 180° and 270° around the first stirrup opening and a second end located at an angular position of between 0° and 90° around the first stirrup opening.

In embodiments of the roller tappet, the second stirrup includes a second region having a second depth below a second interior surface of the second stirrup. Further, the second region extends from a third end to a fourth end, and the third end and the fourth end are separated by 150° to 210° around the second stirrup opening. In certain embodiments, the first depth of the first region is from 0.010 mm to 0.100 mm below the first interior surface, and the second depth of the second region is from 0.010 mm to 0.100 mm below the second interior surface. Further, at least one of the first end or the second end of the first region and at least one of the third end or the fourth end of the second region has a ramped surface forming an angle of from 5° to 30° with a plane defined by the first interior surface and the second interior surface, respectively.

Further, in embodiments of the roller tappet, the second region of the second stirrup substantially mirrors the first region of the first stirrup.

Additionally, in some embodiments, the first region is divided into a first section and a second section separated by an interruption that has a surface that is flush with the first interior surface. The first stirrup may also include a counter region having the first depth below the first interior surface. In such embodiments, the roller pin may define a roller pin axis, and the roller may include a hub face having a first radius extending from the roller pin axis. The first region has a first width defining a second radius from the roller pin axis in which the second radius is greater than the first radius. Further, the counter region has a second width defining a third radius from the roller pin axis in which the third radius is less than the first radius.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
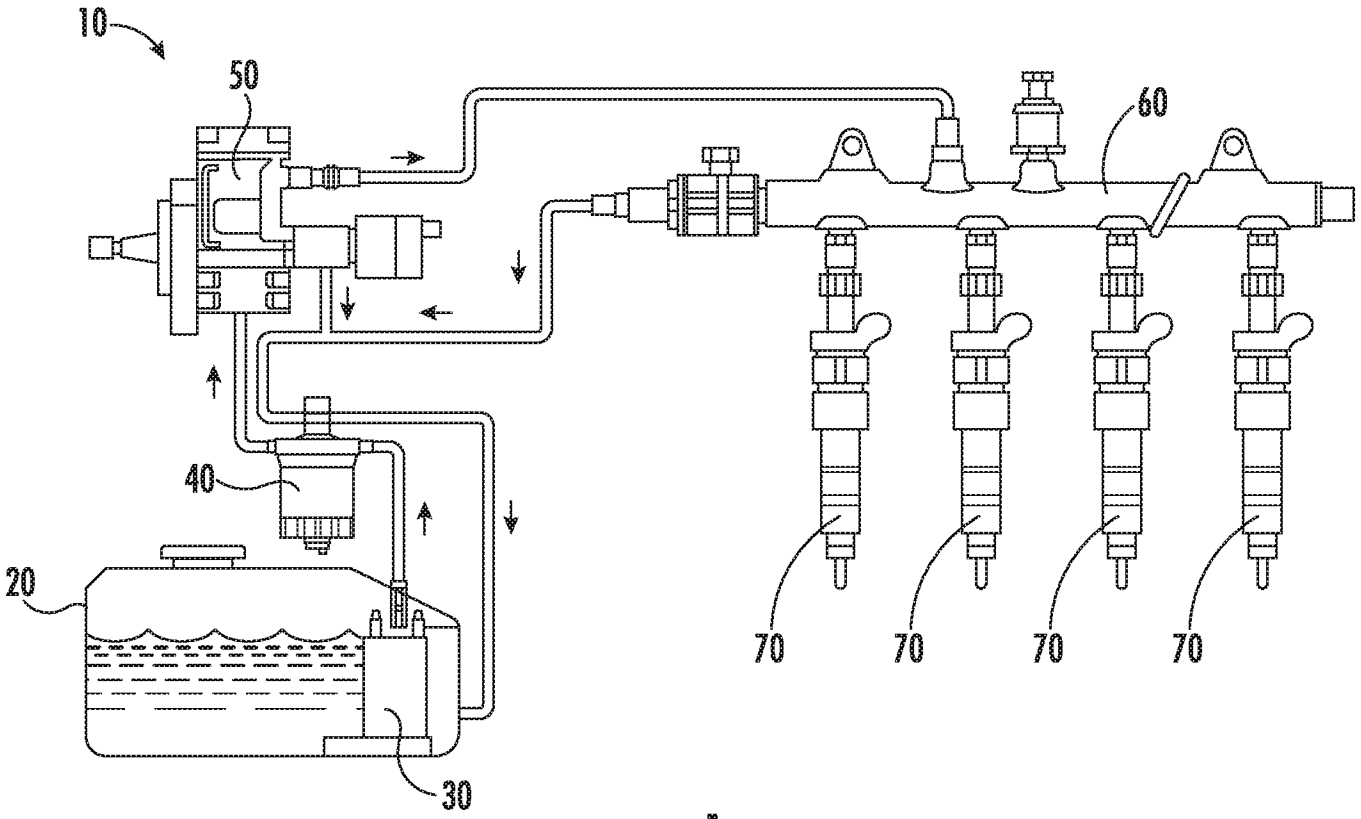
FIG. 1 is a schematic depiction of a fuel system, according to an exemplary embodiment.

FIG. 1 depicts a schematic representation of a fuel delivery system 10. In embodiments, the fuel delivery system 10 particularly relates to high pressure common rail (HPCR) diesel engines. Such HPCR diesel engines can be utilized in a variety of contexts, such as automobiles, marine engines, locomotives, mining equipment, and industrial generators, among others. However, besides HPCR diesel engines, the disclosure also pertains to other fuel systems, such as gas engines and dual fuel engines, among others. In the embodiment depicted, the fuel delivery system 10 includes a tank 20 for storage of fuel. In embodiments, the tank 20 includes a low pressure transfer pump 30 to pump the fuel from the tank 20 and through a fuel filter 40. The fuel filter 40 cleans the fuel before entering a high pressure pump 50. The high pressure pump 50 pressurizes the fuel and delivers it to a common rail 60. A plurality of fuel injectors 70 are in fluid communication with the common rail 60, and the fuel injectors 70 inject the fuel into combustion cylinders of an internal combustion engine (not shown).

Figure 2:
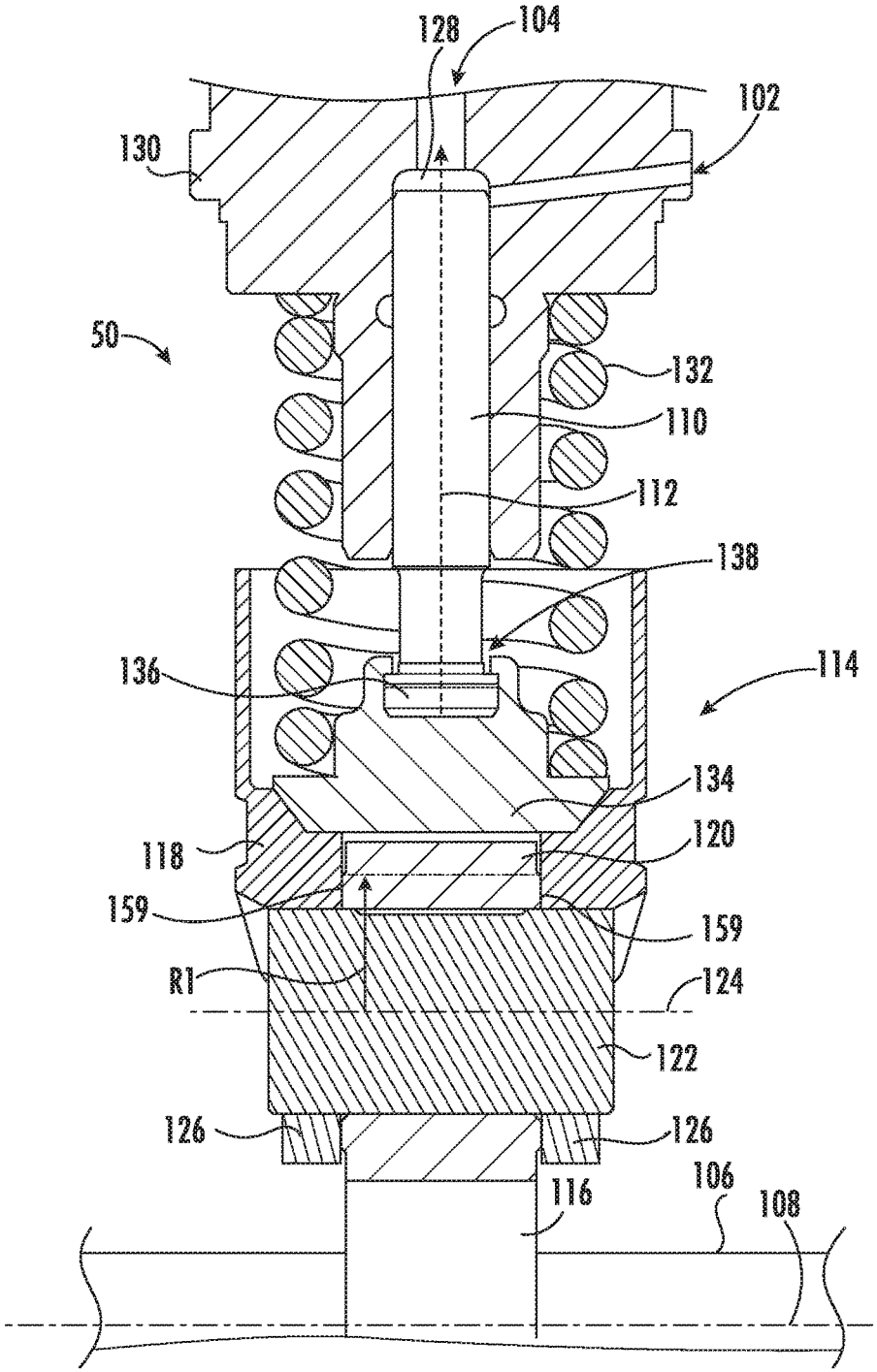
FIG. 2 is a partial sectional view of a fuel pump of the fuel system, according to an exemplary embodiment.

FIG. 2 is a simplified partial cross-sectional illustration of an exemplary embodiment of a high pressure pump 50 (e.g. high pressure pump 50 of FIG. 1). The pump 50 includes an inlet port 102 and an outlet port 104. Fluid enters through the inlet port 102, is pressurized, and then pumped out of outlet port 104. In practice, one or both of the inlet port 102 and the outlet port 104 may contain a valve to ensure fuel flows in the proper direction from the inlet port 102 to the outlet port 104.

To perform the pumping operations, the pump 50 includes a camshaft 106 that rotates about a camshaft axis 108 to drive a plunger 110 in reciprocating motion along a pumping axis 112. The reciprocating motion of the plunger 110 causes the fluid to be pressurized and pumped through the pump 50.

The pump 50 includes a roller tappet arrangement 114 that cooperates with a variable radius lobe 116 of camshaft 106 to transform the rotational motion of the camshaft 106 into the linear motion required for the pumping action.

The roller tappet arrangement 114 generally includes a tappet 118 that rotatably carries a roller 120. The roller 120 is secured on a roller pin 122 for rotation about pin axis 124 relative to tappet 118. The pin axis 124 is substantially parallel to camshaft axis 108 during normal operation. The roller pin 122 is inserted through stirrups 126 (also referred to in art as "tappet ears") of the tappet 118 such that the stirrups 126 carry the roller pin 122 so that the roller 120 is able to rotate about the roller pin axis 124.

The plunger 110 is slidably carried in a pumping chamber 128 formed in a pumping barrel 130 of the pump 50. The pumping chamber 128 is in fluid communication with the inlet port 102 and outlet port 104 such that axial motion of the plunger 110 within the pumping chamber 128 operably causes fluid to be pressurized and pumped out of the outlet port 104.

The plunger 110 is operably coupled to the tappet 118 for substantially coordinated movement with the tappet 118 along the pumping axis 112. As such, when the camshaft 106 rotates and forces the tappet 118 axially along the pumping axis 112 towards the pumping barrel 130, the plunger 110 travels along with the tappet 118 in substantially the same amount of displacement and in substantially the same direction.

A return spring 132 is operably positioned between the pumping barrel 130 and the tappet 118 to axially bias the tappet 118 away from the pumping barrel 130. The biasing forces generated by the return spring 132 when it is compressed are used to return the tappet 118 towards a starting position relative to the camshaft 106. The starting position of the camshaft 106 is the location where the lobe 116 has its smallest radius. In other words, the return spring 132 forces the tappet 118 towards camshaft 106 to maintain radial abutment contact between the outer surface of the roller 120 and the outer surface of the lobe 116. The return spring 132 in the illustrated embodiment is a generally tubular coil spring. The tubular coil spring is generally centered on the pumping axis 112.

The return spring 132 is positioned between the pumping barrel 130 and a spring plate 134. The spring plate 134 is contained at least partially inside a cylindrical retaining wall 136 of the tappet 118, which helps contain and maintain alignment of the return spring 132 and the spring plate 134. In the embodiment shown in FIG. 2 the spring plate 134 is connected to the plunger 110. In such an embodiment, the plunger 110 has a plunger head 136 having a diameter larger than the upstream end of the plunger 110. The spring plate 134 includes an aperture 138 closely sized to the dimensions of the upstream end of the plunger 110 so that a surface of the spring plate 134 surrounding the aperture 138 abuts the plunger head 110.

Figure 3:
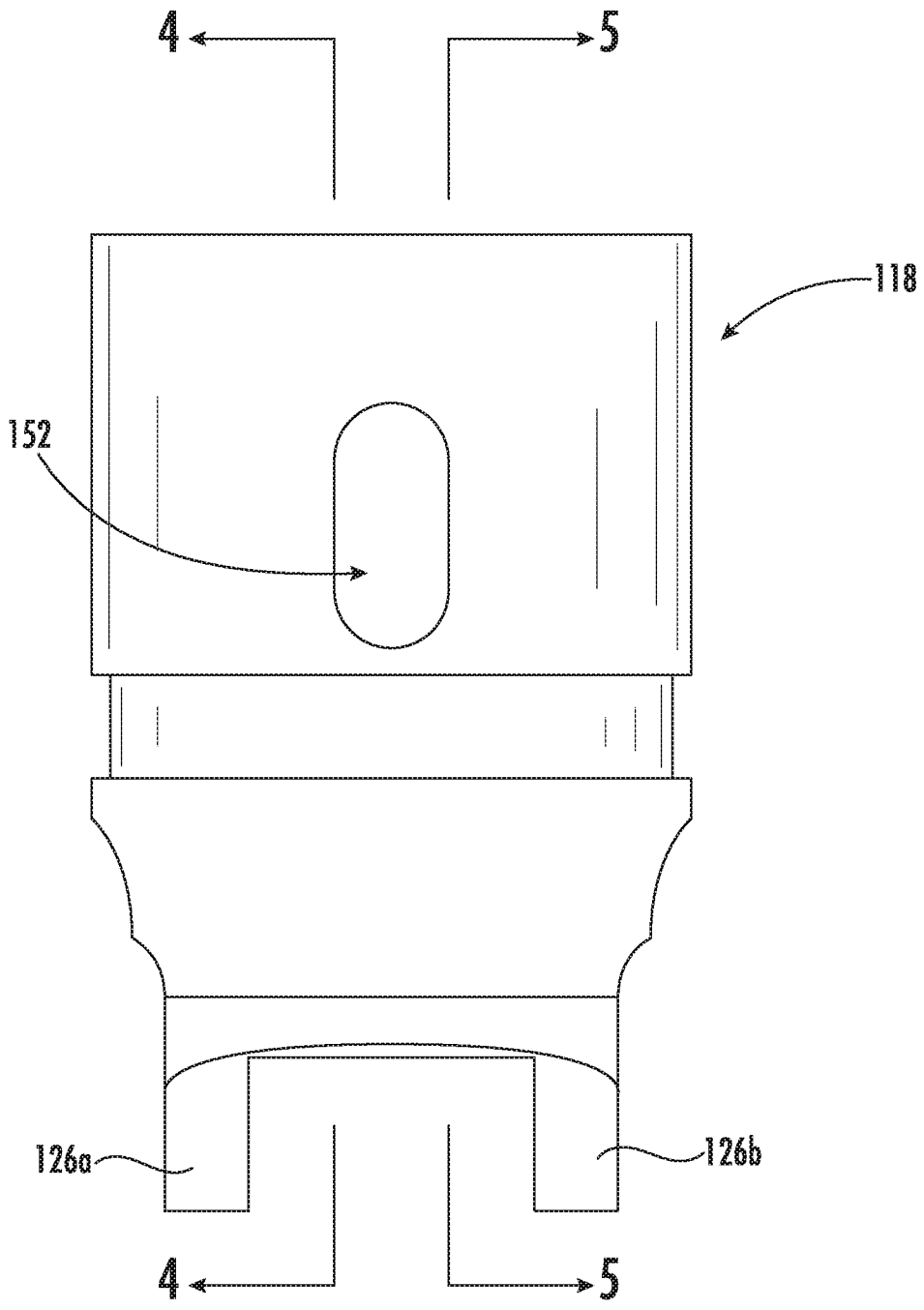
FIG. 3 depicts a tappet of a roller tappet used in the fuel pump, according to an exemplary embodiment.

Having described the general environment for and structure of the pump 50, aspects of the tappet 118 will now be described. FIG. 3 depicts the tappet 118 including the two stirrups 126 configured to hold the roller pin 122 (as shown in FIG. 2). For reference purposes, the two stirrups 126 will be referenced specifically as the first stirrup 126*a* (shown on the left in FIG. 3) and the second stirrup 126*b* (shown on the right in FIG. 3). In the embodiment depicted in FIG. 3, the tappet 118 includes an anti-rotation slot 152 configured to receive, e.g., a bolt (not shown) to prevent rotation of the tappet 118 during operation. By way of providing an additional reference feature, the side of the tappet 118 including the anti-rotation slot 152 will be referred to as the front of the tappet 118, and the side of the tappet 118 without the anti-rotation slot 152 will be referred to as the rear of the tappet 118. With reference to FIGS. 4-7, embodiments of the interior surfaces of the first and second stirrups 126*a*, 126*b* of the tappet 118 will now be described.

Figure 4:
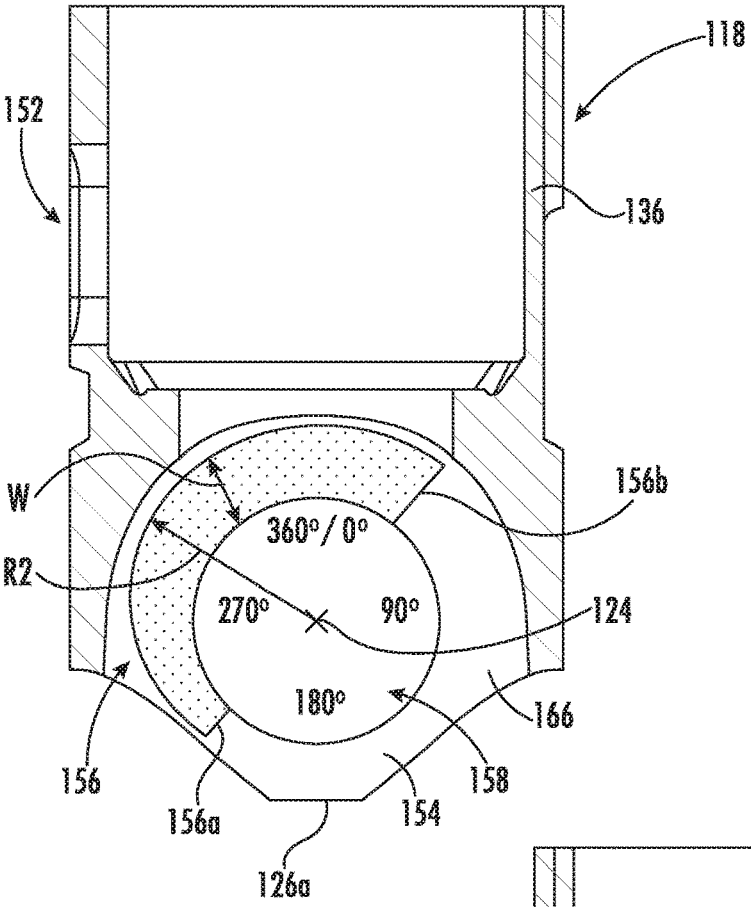
FIG. 4 is a cross-sectional view of the tappet of FIG. 3 taken along line 4-4 and showing a lower depth region on a stirrup of the tappet, according to an exemplary embodiment.

Referring first to FIG. 4, a first interior surface 154 of the first stirrup 126*a* of the tappet 118 is depicted. The first interior surface 154 includes a first region 156 around a first stirrup opening 158 that has a depth lower than the surrounding first interior surface 154. In embodiments, the first region 156 spans about 150° to 210° around the first stirrup opening 158. In particular embodiments, the first region 156 spans about 170° to 190° around the first stirrup opening, and in a specific embodiment, the first region 156 spans about 180° around the first stirrup opening 158. As can be seen in FIG. 4, the first region 156 is substantially oriented towards the front and top of the tappet 118. With reference to the degree positions of the first stirrup opening 158 shown in FIG. 4, the first region 156 begins at a first end 156*a* between 180° and 270°, particularly between 200° and 250°, and most particularly at about 210°. Further, in embodiments, the first region 156 terminates at a second end 156*b* between 0° and 90°, more particularly between 20° and 70°, and most particularly at about 30°. The first region 156 may be continuous or discontinuous between the first end 156*a* and the second end 156*b*. That is, in embodiments, the depth of the first region 156 around the first stirrup opening 158 is lower than the surrounding first interior surface 154 over the entire span between the first end 156*a* and the second end 156*b*. However, in other embodiments, the material is removed in sections between the first end 156*a* and the second end 156*b* such that sections having a surface flush with the surrounding first interior surface 154 are provided between the first end 156*a* and the second end 156*b*.

Referring back to FIG. 2, the embodiment of the roller 120 depicted includes a hub face 159 at each end of the roller 120 along the roller pin axis 124 (however, in other embodiments, the roller 120 does not include a hub face 159). Each hub face 159 has a first radius R1 as measured from the roller pin axis 124. Turning back to FIG. 4, the first region 156 of the first stirrup 126*a* has a radial width W around the first stirrup opening 158 that defines a second radius R2 as measured from the roller pin axis 124. In embodiments, the second radius R2 of the first region 156 is greater than the first radius R1 of the hub face 159 (as shown in FIG. 2). By providing a larger radius R2 for the first region 156, it can be ensured that the hub face 159 of the roller 120 (shown in FIG. 2) will not rub against the first region 156, and lubricating oil contained in the first region 156 can escape past the edge of the hub face 159 (shown in FIG. 2). In other embodiments, such as embodiments not including a hub face on the roller, the second radius R2 may be larger than the radius of the roller 120 (shown in FIG. 2).

In embodiments, only one stirrup includes a region having a depth lower than the surrounding interior surface. As mentioned above, the lower depth region addresses the problem associated with the roller pushing against the stirrup during pump operation. If, in a particular application, the pump only operates in one direction, then only a single stirrup is modified in embodiments to include a lower-depth region of the tappet because the roller will be urged against only one of the stirrups. However, if the pump, in another particular application, operates in both directions, then both stirrups are modified to include lower-depth regions in embodiments of the tappet.

Figure 5:
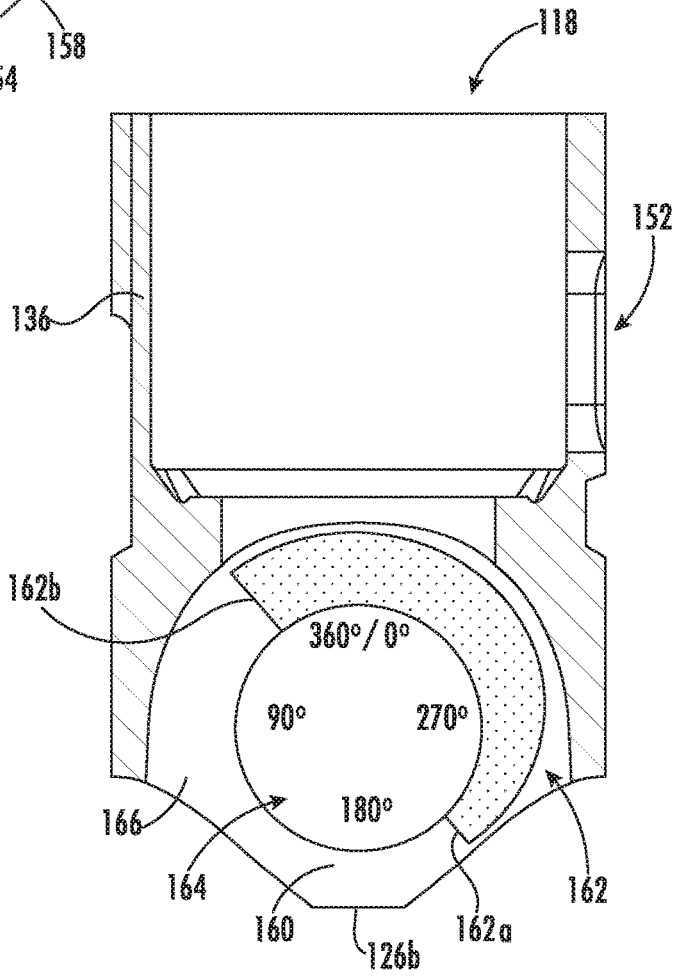
FIG. 5 is a cross-section view of the tappet of FIG. 3 taken along line 5-5 showing another lower depth region on another stirrup of the tappet, according to an exemplary embodiment.

With respect to the latter embodiment, FIG. 5 depicts the second stirrup 126*b* including second interior surface 160 with a second region 162 around a second stirrup opening 164 in which the depth of the second region 162 is lower than the surrounding second interior surface 160. The second stirrup 126*b* substantially mirrors the first stirrup 126*a* of FIG. 4 in that the span of the second region 162 shown in FIG. 5 has substantially the same angular position around the second stirrup opening 160 and substantially the same depth. Thus, in embodiments, the second region 162 spans about 150° to 210° around the second stirrup opening 164, more particularly about 170° to 190° around the second stirrup opening 164, and most particularly about 180° around the second stirrup opening 164. With reference to the degree positions of the second stirrup opening 164 (mirrored from the degree positions of the first stirrup opening 158 shown in FIG. 4), the second region 162 begins at a first end 162*a* between 180° and 270°, particularly between 200° and 250°, and most particularly at about 210°. Further, in embodiments, the second region 162 terminates at a second end 162*b* between 0° and 90°, more particularly between 20° and 70°, and most particularly at about 30°. Further, the second region 162 may be continuous or discontinuous between the first end 162*a* and the second end 162*b*.

The lower depth regions 156, 162 shown in FIGS. 4 and 5 create counter areas 166 of the respective first interior surface 154 and second interior surface 160 where the roller will preferentially touch the stirrups 126*a*, 126*b*. In these areas 166 counter to the lower-depth regions 156, 160, the roller will be directed away from the stirrups 126*a*, 126*b* and avoid digging into the interior surfaces 154, 160 of the stirrups 126*a*, 126*b*. Further, in the lower-depth regions 156, 162, lubrication oil is provided to flush oil between the roller and tappet surface to act as a cooling medium and to create a dynamic oil film between the roller and the stirrups 126*a*, 126*b* in the counter areas 166 where the roller is intended to touch the stirrups 126*a*, 126*b*, which prevents metal-to-metal contact.

Figure 6:
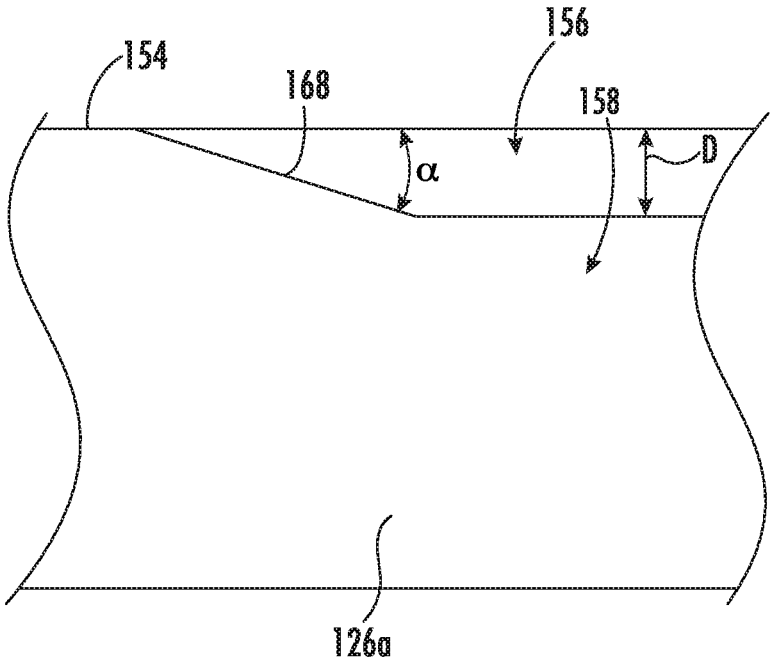
FIG. 6 depicts a side view of a portion of a lower depth region, according to an exemplary embodiment.

FIG. 6 depicts a portion of the lower-depth first region 156 surrounding the first stirrup opening 158. As can be seen in FIG. 6, the first end 156*a* of the first region 156 includes a ramped surface 168. In embodiments, the ramped surface 168 is angled downwardly from a plane defined by the first interior surface 154 at an angle $\alpha$ of from 5° to 30°. More particularly, in embodiments, the angle $\alpha$ of ramped surface 168 is from 10° to 20°, and in a particular embodiment, the angle $\alpha$ of the ramped surface 168 is about 15°. The angle $\alpha$ is selected so that lubrication oil can be drawn into and out of the first region 156 without causing cavitation of the lubrication oil. The ramped surface 168 angles downwardly until a desired depth D of the first region 156 is reached. In embodiments, the depth D below the first surface 154 is from 0.010 mm to 0.100 mm. In other embodiments, the depth D below the first surface 154 is from 0.025 to 0.075 mm, and in a particular embodiment, the depth D below the first surface 154 is about 0.050 mm.

While not shown in FIG. 6, in embodiments, the second end 156*b* of the first region 156 also includes a ramped surface 168 that is angled at 5° to 30°, more particularly at 10° to 20°, and in particular at about 15°. Additionally, in embodiments, the second region 162 also includes ramped surfaces 168 at its respective first and/or second ends 162*a*, 162*b*. In embodiments, the ramped surfaces 168 of the second region 162 are angled at 5° to 30°, more particularly at 10° to 20°, and in particular at about 15°, down to a depth of 0.010 to 0.100 mm, more particularly 0.025 to 0.075 mm, and in particular to about 0.050 mm.

In embodiments, the lower-depth regions 156, 162 are created through manufacturing the tappet 118 in a manner that concurrently forms the lower-depth region 156, 162 (e.g., casting or molding), or in other embodiments, the lower-depth regions 156, 162 are created by manufacturing the tappet 118 having flat interior surfaces 154, 160 and then removing material from the flat interior surfaces 154, 160 until the desired depth and shape are achieved. In the latter embodiments, the material of the stirrups 126*a*, 126*b* may be removed in a variety of suitable ways. In a particular embodiment, the material is removed from the first region 156 and/or second region 162 via electrical discharge machining (EDM). In other embodiments, the material of the stirrups 126*a*, 126*b* may be removed using, e.g., milling techniques, electrochemical machining, or abrasive jet machining, among others. In material removal embodiments, the method of machining creates a random surface having a surface roughness of 10 to 150 microinch Ra.

Figure 7:
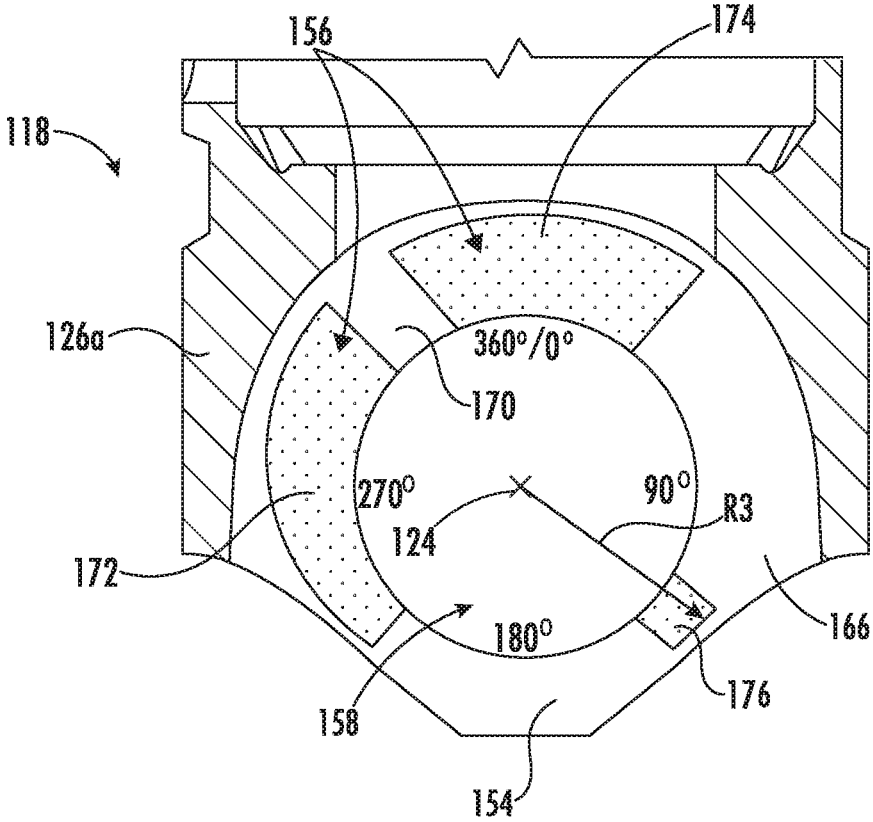
FIG. 7 depicts another embodiment of a stirrup of a tappet having an interruption in the lower depth region and having a further lower depth region, according to an exemplary embodiment.

FIG. 7 depicts another embodiment of the first stirrup 126*a* of the tappet 118. In the embodiment of FIG. 7, the first region 156 is discontinuous between the first end 156*a* and the second end 156*b*. In particular, the first region 156 includes an interruption 170 having a surface that is flush with the first interior surface 154 of the first stirrup 156*a*. The interruption 170 divides the first region 156 into a first section 172 and a second section 174. In embodiments, the interruption 170 helps to increase the lubrication pressure in the sections 172, 174. Further, in embodiments, ramped surfaces may be provided leading into and out of the interruption 170. In embodiments, the interruption 170 is located at an angular position between 270° and 360°, more particularly between 285° and 345°.

In embodiments, the first stirrup 126*a* may also include a counter region 176 having a depth lower than the surface of the counter area 166. In embodiments, the counter region 176 includes ramped surfaces leading into and out of the counter region 176. In embodiments, the counter region 176 is arranged diametrically to the interruption 170. However, in other embodiments, the first region 156 is continuous, and the counter region 176 is placed along a portion of the arc around the first stirrup opening 158 not occupied by the first region 156. In an embodiment, the counter region 176 is located towards the bottom, rear of the first stirrup 126*a*. In particular embodiments, the counter region 176 is located at an angular position of between 90° and 180° around the first stirrup opening 158, more particularly between 105° and 165°. Further, the counter region 176 has a depth of from 0.010 mm to 0.100 mm, more particularly, 0.025 mm to 0.075 mm, and in particular about 0.050 mm. In embodiments, the counter region 176 is used to provide additional lubrication oil between the first interior surface 154 of the first stirrup 126*a* and the roller 120 (as shown in FIG. 2). In embodiments, counter region 176 defines a radius R3 with respect to the roller axis 124 that is less than the radius R1 of the roller hub face 159 (as shown in FIG. 2). In this way, pressure is generated in the counter region 176 forcing oil between the roller and tappet and pushing the roller away from the tappet.

While the interruption 170 and counter region 176 were described in relation to the first stirrup 126*a*, the second stirrup may also include an interruption and a counter region that substantially mirror the interruption 170 and counter region 176 of the first stirrup 126*a*.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A tappet for carrying a roller that follows a cam surface, the tappet having a front and a back, the tappet comprising:

a first stirrup having a first stirrup opening, the first stirrup opening having a plurality of angular positions from 0° to 360° with 90° corresponding to the back of the tappet, 270° corresponding to the front of the tappet, and 180° corresponding to a bottom of the tappet configured to be closest to the cam surface;

a second stirrup having a second stirrup opening, wherein the first stirrup opening and the second stirrup opening are configured to carry a roller pin on which the roller is provided;

wherein the first stirrup comprises a first recessed region having a first depth below a first interior surface of the first stirrup;

wherein an angular position of a first end of the first recessed region is located between angular positions 180° and 270° and an angular position of a second end of the first recessed region is located between angular positions 0° and 90° such that the first recessed region extends 150° to 210° around the first stirrup opening.

2. The tappet of claim 1, wherein the first depth of the first recessed region is 0.010 mm to 0.100 mm below the first interior surface.

3. The tappet of claim 2, wherein at least one of the first end or the second end comprises a ramped surface, the ramped surface forming an angle of 5° to 30° with a plane defined by the first interior surface.

4. The tappet of claim 1, wherein the first recessed region is continuous between the first end and the second end.

5. The tappet of claim 1, wherein the first recessed region is discontinuous between the first end and the second end.

6. The tappet of claim 5, wherein the first recessed region is divided into a first recessed section and a second recessed section separated by an interruption, the interruption having a surface that is flush with the first interior surface.

7. The tappet of claim 6, wherein an angular position of the interruption is located between angular positions 270° and 360°.

8. The tappet of claim 6, wherein the first stirrup further comprises a counter recessed region having a depth equal to the first depth, an angular position of the counter recessed region is located between angular positions 90° and 180°.

9. The tappet of claim 8, wherein the counter recessed region is diametrically opposed to the interruption of the first region.

10. The tappet of claim 8, wherein the roller pin defines a roller pin axis, wherein the roller comprises a hub face having a first radius extending from the roller pin axis, and wherein the counter recessed region has an outer circumferential edge defining a second radius from the roller pin axis, the second radius being less than the first radius.

11. The tappet of claim 1, wherein the second stirrup has a plurality of angular positions from 0° to 360° with 90° corresponding to the back of the tappet, 270° corresponding to the front of the tappet, and 180° corresponding to the bottom of the tappet;

wherein the second stirrup comprises a second recessed region having a second depth below a second interior surface of the second stirrup;

wherein an angular position of a third end of the second recessed region is located between angular positions 180° and 270° of the second stirrup and an angular position of a fourth end of the second recessed region is located between angular positions 0° and 90° of the second stirrup such that the second region extends 150° to 210° around the second stirrup opening.

12. The tappet of claim 11, wherein the second recessed region substantially mirrors the first recessed region.

13. The tappet of claim 1, wherein the roller pin defines a roller pin axis, wherein the roller comprises a hub face having a first radius extending from the roller pin axis, and wherein the first recessed region has an outer circumferential edge defining a second radius from the roller pin axis, the second radius being greater than the first radius.

14. A roller tappet, comprising:

a roller configured to follow a cam surface;

a roller pin carrying the roller;

a tappet including a first stirrup having a first stirrup opening and a second stirrup having a second stirrup opening;

wherein the roller pin is supported by the first stirrup opening and the second stirrup opening;

wherein the first stirrup opening has a plurality of angular positions from 0° to 360° with 90° corresponding to a back of the tappet, 270° corresponding to a front of the tappet, and 180° corresponding to a bottom of the tappet configured to be closest to the cam surface;

wherein the first stirrup comprises a first recessed region having a first depth below a first interior surface of the first stirrup;

wherein an angular position of a first end of the first recessed region is located between angular positions 180° and 270° and an angular position of a second end of the first recessed region is located between angular positions 0° and 90° such that the first recessed region extends 150° to 210° around the first stirrup opening.

15. The roller tappet of claim 14, wherein the second stirrup opening has a plurality of angular positions from 0° to 360° with 90° corresponding to the back of the tappet, 270° corresponding to the front of the tappet, and 180° corresponding to the bottom of the tappet wherein the second stirrup comprises a second recessed region having a second depth below a second interior surface of the second stirrup;

wherein an angular position of a third end of the second recessed region is located between angular positions 180° and 270° of the second stirrup opening and an angular position of a fourth end of the second recessed region is located between angular positions 0° and 90° of the second stirrup opening such that the second recessed region extends 150° to 210° around the second stirrup opening.

16. The roller tappet of claim 15, wherein the first depth is 0.010 mm to 0.100 mm below the first interior surface and the second depth is 0.010 mm to 0.100 mm below the second interior surface.

17. The roller tappet of claim 16, wherein at least one of the first end or the second end and at least one of the third end or the fourth end comprises a ramped surface, the ramped surface forming an angle of 5° to 30° with the first interior surface and the second interior surface, respectively.

18. The roller tappet of claim 15, wherein the second recessed region substantially mirrors the first recessed region.

19. The roller tappet of claim 14, wherein the first recessed region is divided into a first recessed section and a second recessed section separated by an interruption, the interruption having a surface that is flush with the first interior surface;

wherein the first stirrup further comprises a counter recessed region having a depth equal to the first depth.

20. The roller tappet of claim 19, wherein the roller pin defines a roller pin axis;

wherein the roller comprises a hub face having a first radius extending from the roller pin axis;

wherein the first recessed region has a first outer circumferential edge defining a second radius from the roller pin axis, the second radius being greater than the first radius; and wherein the counter recessed region has a second outer circumferential edge defining a third radius from the roller pin axis, the third radius being less than the first radius.

* * * * *